United States Patent [19]

Cafiero

[11] Patent Number: 4,457,427

[45] Date of Patent: Jul. 3, 1984

[54] CAPSULE PUNCTURING DEVICE

[75] Inventor: Thomas A. Cafiero, Brooklyn, N.Y.

[73] Assignee: Michigan Hanger Company, Hubbard, Ohio

[21] Appl. No.: 420,091

[22] Filed: Sep. 14, 1982

[51] Int. Cl.[3] ..... B65D 69/00; B65D 35/56; B43K 5/14

[52] U.S. Cl. ..... 206/229; 206/531; 206/484; 222/81; 222/88

[58] Field of Search ..... 206/532, 531, 528, 216, 206/229, 484; 222/80, 81, 88

[56] References Cited

U.S. PATENT DOCUMENTS

| | | | |
|---|---|---|---|
| D. 255,427 | 6/1980 | Borkan | 9/261 |
| 1,100,433 | 6/1914 | Johnson | 222/81 |
| 2,393,103 | 1/1946 | Groedel | 206/216 |
| 2,717,661 | 9/1955 | Mayfield | 206/528 |
| 3,817,426 | 6/1974 | Fooks | 222/88 |
| 3,993,190 | 11/1976 | Schmidgall | 206/531 |
| 4,159,568 | 7/1979 | Berner | 30/124 |

OTHER PUBLICATIONS

U.S. Pat. Appln. D-415,976, filed Sep. 8, 1982 (Borkan and Cafiero).

U.S. Pat. Appln. D-415,975, filed Sep. 8, 1982 (Borkan and Cafiero).

*Primary Examiner*—William T. Dixson, Jr.

*Attorney, Agent, or Firm*—Harpman & Harpman

[57] ABSTRACT

The present invention discloses card-type packages for holding and displaying flexible capsules and the like, and more particularly to a card having a puncturing means for opening the capsules.

8 Claims, 6 Drawing Figures

Fig. 1.
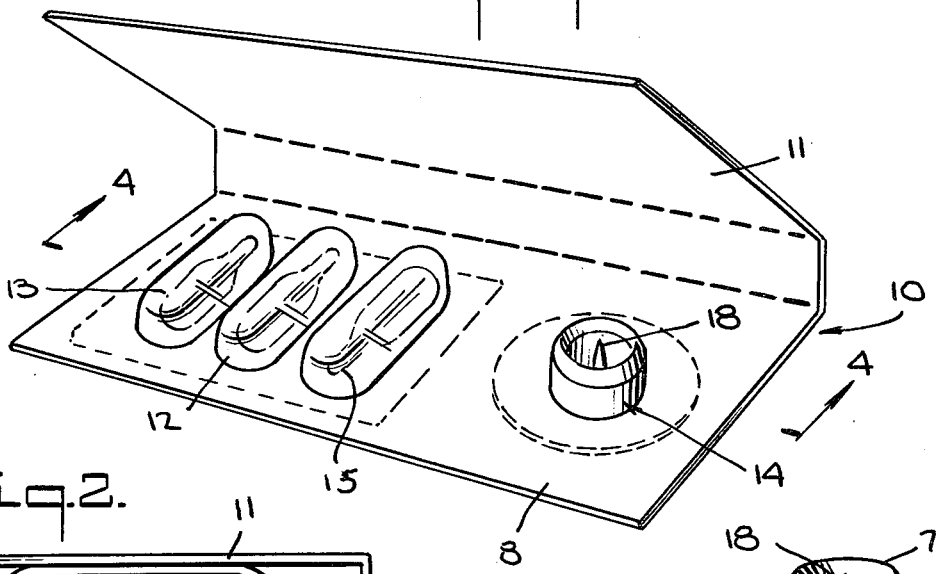
Fig. 2.
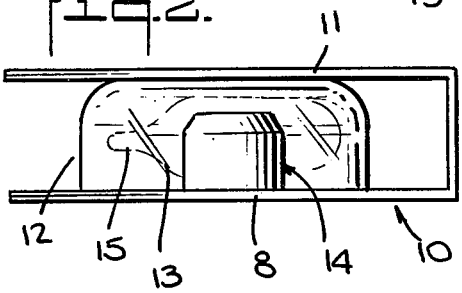
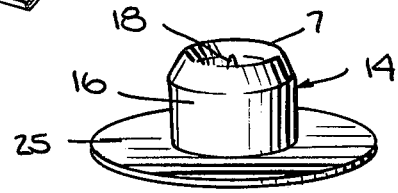
Fig. 3.
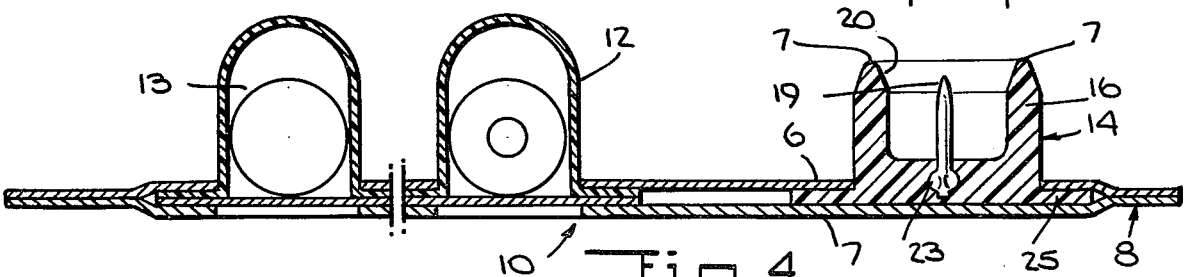
Fig. 4.
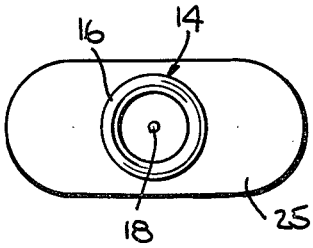
Fig. 6.
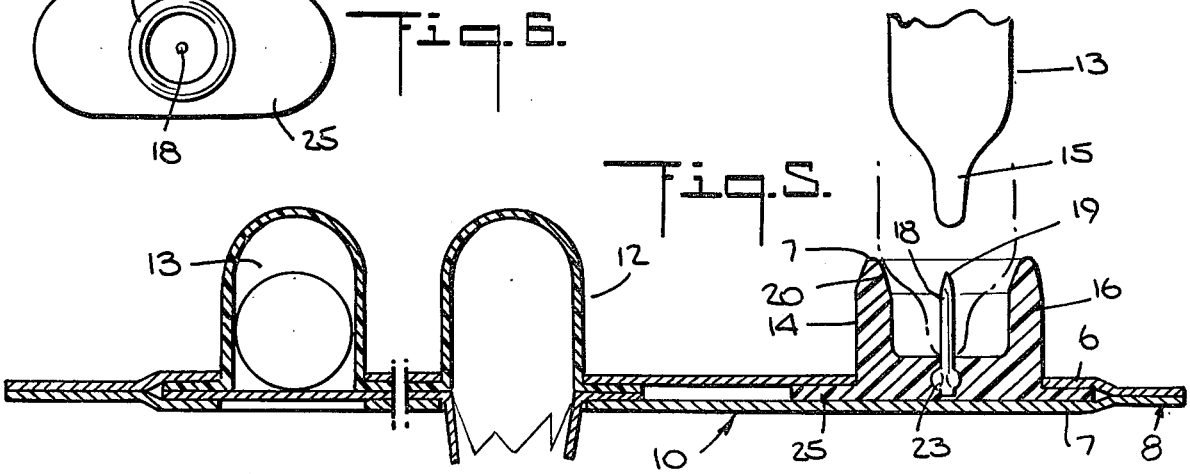
Fig. 5.

CAPSULE PUNCTURING DEVICE

BACKGROUND OF THE INVENTION

The present invention relates to cards for holding and displaying flexible capsules and the like and more particularly to a card having a puncturing means for opening the capsules.

The use of cards or blister packs to contain and display storage capsules containing creams and ointments as carriers for cosmetics, vitamins, flavorings, dietary supplements and the like is well known The capsules are often formed of clear elastic material, such as gelatin, plastic and the like and may be attached to the surface of the card by enclosing them in clear plastic bubbles which are broken by the user to release the capsule. It is quite often necessary to pierce, cut or to otherwise puncture the capsules either to extract the substance contained in the capsule or to reduce the size of the dosage. Heretofore, a sharp instrument such as a pin or scissor point was required to puncture the capsule. Such puncturing instruments, however are not usually carried and puncturing the capsule while away from one's home or place of business presented an inconvenience. Moreover even when the user was in his home or place of business, it was inconvenient to puncture the capsule since one still had to obtain an instrument which was not usually stored with the capsules.

A partial solution to the above problems is found in commonly-assigned U.S. Pat. No. 4,159,568 which discloses a capsule storage container comprising an associated cutter for opening capsules having a tapered end, and in commonly assigned U.S. Pat. No. Des. 255,427 which shows capsule piercing devices, designed to be associated with capsule container closure members.

In accordance with the invention disclosed herein, capsules are attached to, and/or carried on a display card which also includes a puncturing means with which the capsules may be easily and conveniently punctured without the need for puncturing instruments separated from the card. The card may be formed into a folded container so that a portion of the card acts as a lid to cover and protect the puncturing means and the capsules.

SUMMARY OF THE INVENTION

It is an object of the present invention to provide a generally flat package for holding capsules and the like which has associated therewith means for easily and conveniently puncturing the capsules.

It is also an object of the present invention to provide a blister-pack display card for holding capsules and the like which has associated therewith means for easily and conveniently puncturing the capsules.

It is another object of the present invention to provide a puncturing means for the above package or card which means is child-proof, i.e., which presents little or no danger if swallowed by a child.

These and other objects are achieved in accordance with the invention by a card-type package having attached thereto one or more capsules and a means for puncturing the capsules. The puncturing means comprises a pin and a guiding means therefore for guiding the capsule to the pin as the capsule is drawn towards the pin. The guiding means is configured so as to cooperate with the configuration of the capsule as the capsule is drawn towards the pin. The puncturing means preferably comprises a generally cylindrical, cup-shaped guiding member and a pin having one pointed end and one blunt end which is secured axially within the interior space of the guiding member with the pointed end adjacent to the open end of the guiding member. The pin is secured against movement and against separation from the guiding member by setting its blunt end within the bottom wall of the guiding member. The blunt end of the pin also preferably includes an upset portion set in the bottom wall to further prevent removal of the pin. Preferably, the guiding member is formed by a molding process so as to tightly encompass the blunt end of the pin. The puncturing means is thus child-proof in that the pin cannot be separated from the guiding member, even if the puncturing means is ingested. The pin is also preferably positioned within the interior space of the guiding member so that its pointed end does not extend beyond the lip of the guiding member. This positioning of the pin provides a safety factor so that the user is less likely to prick his finger when using the pricking means to open a capsule.

Further in accordance with the preferred embodiments, the internal diameter of the interior portion of the guiding member is sized so that the part of the capsule to be punctured is easily admitted into the interior spaces to contact the pin while the finger of the average user would be substantially or completely excluded therefrom.

In the preferred embodiments, each puncturing means further comprises a base for the guiding member which operates in conjunction with the card-type package to secure the puncturing means to the package, preferably without the use of adhesives. The base and the guiding member are preferably axially aligned and the base is secured to the package so that the guiding member extends transversely, preferably normally, from a longitudinally-extending surface of the package.

BRIEF DESCRIPTION OF THE DRAWINGS

The present invention is illustrated by way of example and not by limitation in the figures of the accompanying drawings in which like references indicate similar parts and in which:

FIG. 1 is a front perspective view of the card-type package with capsules and the puncturing means affixed thereto according to the invention.

FIG. 2 is an enlarged side view depicting the puncturing means attached to the card-type package according to the invention.

FIG. 3 is a perspective view of the puncturing means according to a preferred embodiment of the invention.

FIG. 4 is an enlarged cross-sectional view taken through the package of FIG. 1 along line 4—4 of FIG. 1.

FIG. 5 is an enlarged cross-sectional view taken through FIG. 1 depicting the puncturing means in conjunction with the capsule, to illustrate its mode of use.

DESCRIPTION OF THE PREFERRED EMBODIMENTS

Referring now more particularly to the drawings, the card-type package (10) may be formed of one or more sheets of a flexible material such as cardboard plastic or stiff paper. As shown in FIG. 1, the card is preferably foldable so that a portion of the material functions as a moveable lid (11) which may be closed so as to cover and protect the blister containers (12) containing the capsules (13) and to cover the puncturing means (14), both of which are secured to the portion of the container which is designated as the support (8). The container may thus be displayed in either the open or closed position, as shown in FIGS. 1 and 2, respectively, and advertising messages or other information may be printed on either surface of the lid or on the support. The support portion of the card has attached thereto one or more capsules (13) which are preferably shaped so as to comprise a tapered tip (15) of a size suitable for admission into the interior space of the puncturing means (14) so as to be contacted by and punctured by the pin (18) positioned therein as shown in FIG. 5. The capsules are preferably enclosed within transparent plastic bubbles (12) so as to attach them firmly to the supporting sheet (8).

The puncturing means (14) as shown in FIGS. 3, 4 and 5 comprises a cup-shaped guiding member (16) and a pin (18) affixed axially within the interior space of the guiding member so that the pointed end (19) of the pin is positioned at or slightly below the center of the plane defined by the outermost surface of the lip (7) of the guiding member. In a preferred embodiment of this invention, the lip surface is wholly or partially tapered (20) toward the interior surface of the guiding member. This tapering imparts the guiding function to the guiding member (16) which aids in directing the narrowed or tapered tip (15) of the capsule into contact with the pointed end (19) of the pin (18) when the capsule is inserted into the interior space of the guiding member as shown in FIG. 5. The diameter of the interior space of the guiding member is selected so as to admit the capsule to an extent sufficient to permit the pointed end of the pin to pierce the capsule. Therefore, the interior side walls of the guiding member need not define a perfect cylinder as shown in FIGS. 4, 5 or 6, but may be tapered inwardly, stepped or otherwise arranged so as to allow the easy entry and withdrawal of capsules of any given geometry. The pin (18) may be axially fixed within the interior space of the guiding member by setting its blunt end (23) into the bottom wall of the guiding member as shown in FIGS. 4 and 5. This method of attaching the pin is preferred over other attachment methods, for example, setting the blunt end of the pin into a pool of adhesive, since it integrally binds the pin and the guiding member, thus minimizing the possibility that the pin will become detached during use of the puncturing means. To further enhance the attachment of the pin, its blunt end (23) may be widened by attachment of a head or by forming the blunt end into an upset as illustrated in FIGS. 4 and 5. Such widening of the blunt end functions to improve its grip within the body of the guiding member, thus imparting further resistance to tipping the pin or to pulling it out of the member wall. This method of attachment of the pin to the guiding member renders the puncturing means child-proof in that the pin cannot become detached should the puncturing means be ingested.

The puncturing means also comprises a base (25) to which the guiding member is attached, preferably in a perpendicular fashion as shown in FIGS. 3 and 6. The guiding member may be attached to the base by simply adhering its outermost bottom wall to the upper surface of the base.

Preferably, however, the base and guiding member are formed in one step, i.e. by molding or stamping, so that the base is an integral part of the puncturing means.

The base (25) may preferably be disc-shaped, said disc having a greater diameter than that of the guiding member (14) as shown in FIG. 3. However the base may be of any shape and thickness compatible with the dimension and thickness of the card so long as its total area is greater than that of the bottom-most cross-section (basal area) of the guiding member. An oblong base (25) is illustrated by FIG. 6.

This areal requirement permits attachment of the puncturing means (14) to the card as shown in FIGS. 4 and 5. The support portion of the card (8) is comprised of two sheets (6 and 7) which are formed by adhering two of the supporting sheets or by folding one sheet so as to leave a space between the upper sheet (6) and the lower sheet (7). The surface of the upper sheet is cut so as to define an opening of area sufficient to allow the guiding member to protrude above the surface of the upper sheet but which is insufficient to permit passage therethrough of the base. The lower sheet (7) acts as a support for the base, which may be further adhered thereto, while the edges of the opening in the upper sheet prevent lateral movement of the guiding member (14). In this manner, the puncturing means may be firmly attached to the card without the use of staples, adhesives, tapes, etc.

The advantages of the present invention, as well as certain changes and modifications of the enclosed embodiments thereof, will be readily apparent to those skilled in the art. It is applicant's intention to cover by his claims all those changes and modifications which could be made to the embodiments of the invention herein chosen for the purpose of disclosure without departing from the spirit and scope of the invention.

What is claimed is:

1. A card-type package for holding and puncturing elastic capsules and the like comprising:
   (a) one or more layers of a flexible supporting sheet;
   (b) one or more elastic capsules attached thereto; and
   (c) puncturing means affixed to said sheet comprising
      (i) a cup-shaped guiding member having an inwardly-tapered interior lip, and which is shaped so as to admit at least a portion of said capsule into the interior space of said guiding member; and
      (ii) a pin axially aligned within the interior space of the guiding member so as to contact and pierce said admitted capsules, wherein said pin has a pointed end which is positioned at or below the plane formed by the lip of the cup-shaped guiding member, and whereby said interior lip directs said admitted portion of said capsule into contact with said pointed end.

2. The package according to claim 1 wherein the puncturing means further comprises a base affixed to said sheet; and said guiding member having a basal area less than that of the base to which it is attached.

3. The package according to claim 2 wherein the guiding member is transversely attached to the base.

4. The package according to claim 2 wherein the puncturing means is attached to the supporting sheet so that the guiding member is perpendicular to the surface of the support sheet.

5. The package according to claim 4 the base of the puncturing means is positioned between two supporting sheets, and wherein the guiding member extends perpendicularly beyond the uppermost supporting sheet through an opening in said uppermost sheet.

6. The package according to claims 2, 3 or 4 wherein said pin comprises a blunt end which is shaped into an upset, said blunt end being secured in said guiding member.

7. The package according to claim 5 wherein the base comprises a flat, geometric shape.

8. The package according to claim 7 wherein the base comprises a disc.

* * * * *

UNITED STATES PATENT AND TRADEMARK OFFICE

CERTIFICATE OF CORRECTION

PATENT NO. : 4,457,427

DATED : July 3, 1984

INVENTOR(S) : Thomas A. Cafiero

It is certified that error appears in the above-identified patent and that said Letters Patent is hereby corrected as shown below:

On the Cover page, Item (73)

after "Assignee:" delete "Michigan Hanger Company, Hubbard, Ohio: and insert--Pharmacaps, Inc., Elizabeth, New Jersey --; and after "Attorney, Agent, or Firm" delete "Harpman and Harpman" and insert --Kenyon & Kenyon--;

Claim 5, line 1, after "4" insert --wherein--.

Signed and Sealed this

*Twelfth* Day of *March 1985*

[SEAL]

*Attest:*

DONALD J. QUIGG

*Attesting Officer* *Acting Commissioner of Patents and Trademarks*